US005411339A

United States Patent [19]

Bahrabadi et al.

[11] Patent Number: 5,411,339

[45] Date of Patent: May 2, 1995

[54] PORTABLE PRINTER AND CARTRIDGE THEREFOR

[75] Inventors: Casey K. Bahrabadi, Phoenix, Ariz.; Arthur J. Paulson, Minneapolis, Minn.

[73] Assignee: Kroy, Inc., Scotsdale, Ariz.

[21] Appl. No.: 164,358

[22] Filed: Dec. 9, 1993

[51] Int. Cl.[6] ..... B41J 11/20; B41J 35/28; B41J 11/04

[52] U.S. Cl. ..... 400/56; 400/208; 400/659

[58] Field of Search ..... 400/56, 55, 208.1, 208, 400/196, 248, 120, 613, 619, 621; 156/387

[56] References Cited

U.S. PATENT DOCUMENTS

| | | | |
|---|---|---|---|
| 4,685,815 | 8/1987 | Barawyi | 400/55 |
| 4,750,880 | 6/1988 | Stephenson et al. | 400/55 |
| 4,815,875 | 3/1989 | Richardson et al. . | |
| 4,966,476 | 10/1990 | Kuzuya et al. . | |
| 5,022,771 | 6/1991 | Paque . | |
| 5,049,228 | 9/1991 | Sato | 400/208 |
| 5,051,009 | 9/1991 | Sugiura et al. | 400/208 |
| 5,064,300 | 11/1991 | Kashiwaba | 400/56 |
| 5,108,205 | 4/1992 | Stone | 400/56 |
| 5,176,458 | 1/1993 | Wirth | 400/56 |
| 5,232,297 | 8/1993 | Kitazawa | 400/621 |
| 5,249,873 | 9/1993 | Okunomiya et al. | 400/208 |
| 5,277,503 | 1/1994 | Nagao | 400/208 |

FOREIGN PATENT DOCUMENTS

| | | | |
|---|---|---|---|
| 4014124 | 11/1991 | Germany | 400/56 |
| 0152975 | 9/1982 | Japan | 400/56 |
| 0199969 | 9/1986 | Japan | 400/56 |
| 0119076 | 5/1987 | Japan | 400/56 |
| 3-230987 | 10/1991 | Japan | 400/55 |

OTHER PUBLICATIONS

"Self-Adjusting Forms Thickness Compensation for a Printer" IBM Tech. Discl. Bulletin, vol. 30, No. 8 1/88 pp. 406–407.

*Primary Examiner*—Eugene H. Eickholt
*Attorney, Agent, or Firm*—Dorsey & Whitney

[57] ABSTRACT

A thermal printing device having a print mechanism which includes a platen roller assembly in combination with a movable print head assembly. Further aspects of the present invention include a switch mechanism and a tape supply cartridge with switch activation/deactivation members for automatically facilitating adjustment of print parameters to match tape supply upon insertion of the cartridge.

14 Claims, 5 Drawing Sheets

PORTABLE PRINTER AND CARTRIDGE THEREFOR

BACKGROUND OF THE INVENTION

1. Field of the Invention

The present invention relates generally to a hand held or portable printer and supply cartridge and more particularly, to a hand held or portable, modular printer having an improved print mechanism with high quality print capabilities and improved print flexibilities. The invention also relates to an improved switch mechanism for managing different types of tape and ribbon and an improved tape/ribbon supply cartridge and printer incorporating such switch mechanism.

2. Description of the Prior Art

A variety of portable printers or labellers currently exist in the art. Some of these are exemplified by U.S. Pat. No. 4,815,875; U.S. Pat. No. 4,966,476 and U.S. Pat. No. 5,02,771. U.S. Pat. No. 4,815,875, issued to Richardson et al., relates to a printer having a print mechanism comprised of a fixed printhead and a movable platen roller mounted within the printer. The specific embodiment discloses the printhead as being fixed relative to the printer and the platen roller as being movable linearally relative to the printer housing into printing alignment with the printhead.

U.S. Pat. No. 4,966,476, issued to Kuzuya et al. relates to a tape printer having both a printhead and a platen roller mounted within the printer. In this patent, the printhead is fixed relative to the printer, while the platen roller is mounted on a swinging arm relative to the printer so that it moves into and out of a print position relative to the printhead along an arcuate path.

U.S. Pat. No. 5,022,771, issued to Paque, is directed to a printer and a tape supply cartridge in which the platen roller is housed within the cartridge and is aligned relative to a support post on the machine when the cartridge is inserted. When the cartridge is locked into position, the printhead is moved into a print position relative to the platen roller.

Although each of the above described prior art printers may be considered portable, none is a modular printer. Further, although each of the above patents discloses a variety of printhead and platen roller combinations, there is a continuing need to improve the mechanisms responsible for the print operation including the platen roller, the printhead and the mechanisms for moving and aligning such elements into a print position upon insertion of a cartridge into the printer.

Still further, none of the above provides a mechanism which, upon insertion of the tape supply cartridge, results in automatic adjustment of the print parameters to manage and best print the particular supply within the cartridge. Conventional thermal transfer products are commonly designed to print on specific sizes or types of tape (i.e.), wax based tapes, resin based tapes, continuous labels, die-cut labels, etc. The ability of these products to vary or adjust their printing parameters to accommodate the particular size or type of tape is limited. Separate printers are often developed or modified to effectively manage a specific tape supply.

Accordingly, a need exists for a printer and/or a tape supply cartridge addressing the above limitations in the prior art.

SUMMARY OF THE INVENTION

The present invention relates generally to a hand held or portable printer or labeller incorporating an improved platen roller assembly, an improved print head assembly and an improved switch mechanism for sensing and identifying the size and type of tape supply in a particular supply cartridge to facilitate an automatic adjustment of the print parameters to manage or best print that particular supply. The present invention also relates to a tape supply cartridge incorporating means for interfacing with such switch mechanism and usable in such printer.

The printer of the present invention embodies a modular construction comprised of a keyboard or input module and a print module. The keyboard and print modules are joined together so that, in combination, they function as a printer or labeller. Both modules, however, can function in combination with other modular units as well. For example, it is contemplated that the print module can be used in combination with a variety of keyboard modules and that the keyboard module can be used in combination with various print modules.

The print module of the present invention includes an improved platen roller assembly in which the platen roller is positioned outside the cartridge and is mounted for rotation on a platen roller support post fixed relative to the machine housing. The platen roller assembly further includes a tape advancement arm or yoke pivotally mounted relative to the platen roller support post for advancing the tape through the printer. The print module also includes an improved print head assembly having a floating print head embodying a force or moment transfer arm which insures uniform pressure and contact throughout the entire length of the print line. The print head assembly is movable between a print position in which the print head is biased toward the platen roller and a non-print position in which the print head is spaced from the platen roller. Such movement between the print and non-print positions is accomplished through a belt driven linkage assembly and rotation of a cartridge locking knob.

The print module also includes an improved switch mechanism in the form of a plurality of mechanical plunger switches which are positioned to interface with mating portions of the tape supply cartridge. Upon insertion of the cartridge, this mechanism senses and identifies the particular size and type of tape within the cartridge and facilitates the automatic adjustment of the print parameters to manage or best print that particular supply. The cartridge of the present invention includes a supply of image receiving tape and a plurality of plunger switch mating portions in the form of a plurality of selectively removable plunger switch stops which interface with the switches within the cartridge cavity. Selective removal of one or more of the stops identifies the particular size and type of tape within the cartridge and transmits such information to the processing unit within the input module.

Accordingly, it is an object of the present invention to provide an improved modular, hand held or portable printer/labeller.

Another object is to provide an improved hand held or portable labeller for office and industrial use.

A further object of the present invention is to provide a printer/having an improved platen roller assembly.

A further object of the present invention is to provide a hand held printer having an improved print head assembly.

A still further object of the present invention is to provide a hand held printer having a print cartridge receiving cavity and a switch mechanism for automatically adjusting the print parameters for the particular tape supply within the cartridge.

A still further object of the present invention is to provide a tape supply cartridge for use in the printer of the present invention in which the cartridge embodies a plurality of mating switch activation/deactivation members for appropriately identifying the size and type of tape within the cartridge.

These and other objects of the present invention will become apparent with reference to the drawings, the description of the preferred embodiment and the appended claims.

DESCRIPTION OF THE PREFERRED EMBODIMENT

Figures 1, 6:
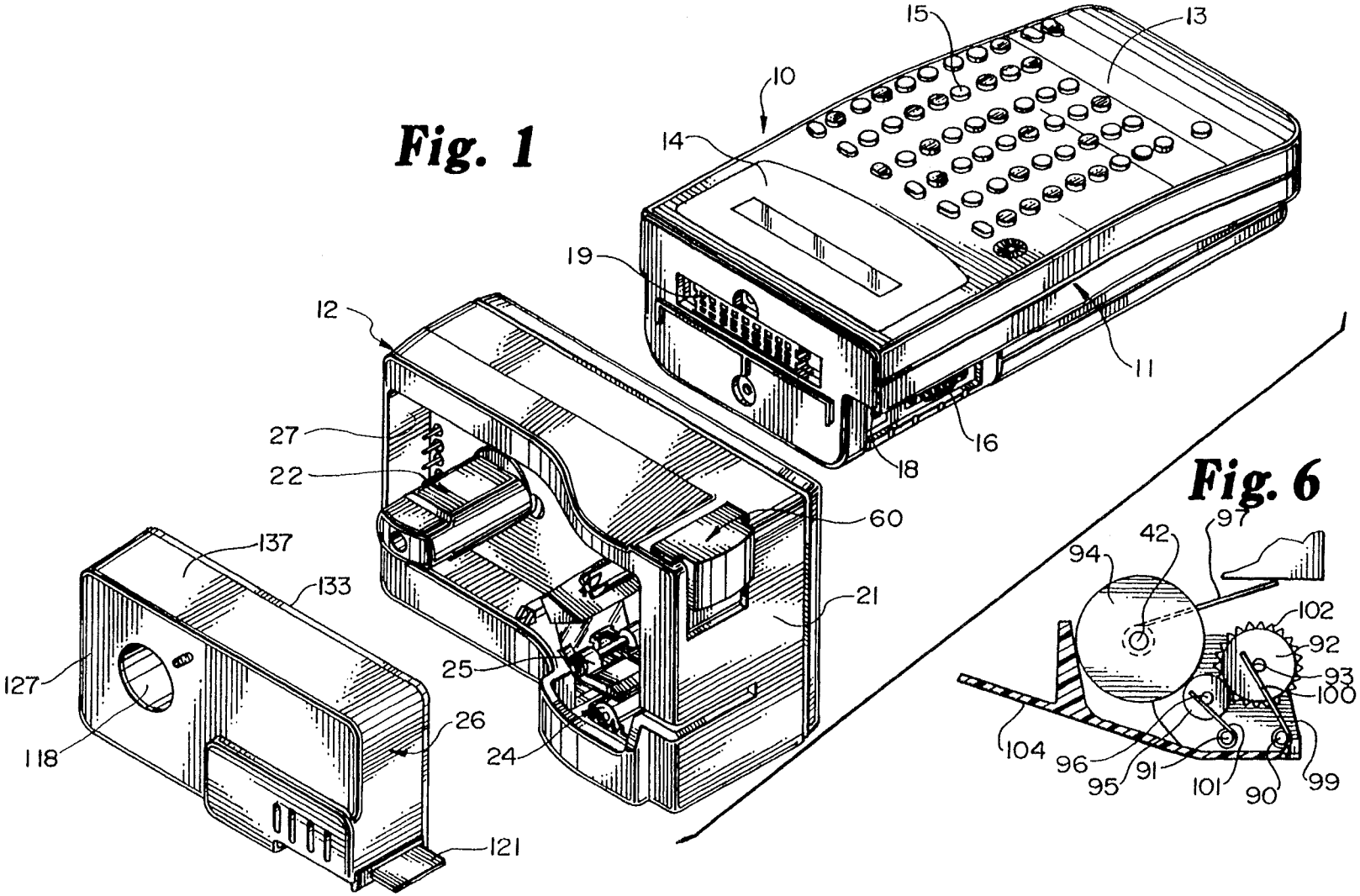
FIG. 1 is an exploded perspective view of the printer of the present invention showing the tape supply cartridge removed.
FIG. 6 is a view, partially in section, of the platen roller assembly with a portion of the top end yoke member removed.

Reference is first made to the exploded perspective view of the printer 10 of the present invention as shown in FIG. 1. The printer 10 is a modular printer having a keyboard module 11, a print module 12 and a replaceable tape supply cartridge 26.

The keyboard module 11 includes a generally rectangular housing 13 having top, bottom and side faces and forward and rearward ends. Positioned on the top face of the housing 13 is a display window 14 and a plurality of function and input keys 15. One side face of the housing 13 is provided with an external power source terminal 18 and an auxiliary input connection 16. The profit end of the housing 13 is provided with a main connection member 19 for electrical interface with a corresponding connection member 35 (FIG. 2) positioned on the rearward face of the print module 12. The operative components within the keyboard module 10 can be any data input and drive mechanisms which are common in the art and are compatible with the structure and features of the print module 12.

The print module 12 is a generally rectangular member having an external housing 21 defined by front 28 and back 29 (or top and bottom) housing portions. The front or top surface of the housing 21 is provided with a cartridge receiving cavity 27 for receiving a replaceable and disposable tape supply cartridge 26. Also disposed within or adjacent to the cartridge cavity 27 is a locking knob assembly 22, a platen roller assembly 24 and a print head assembly 25.

Figure 2:
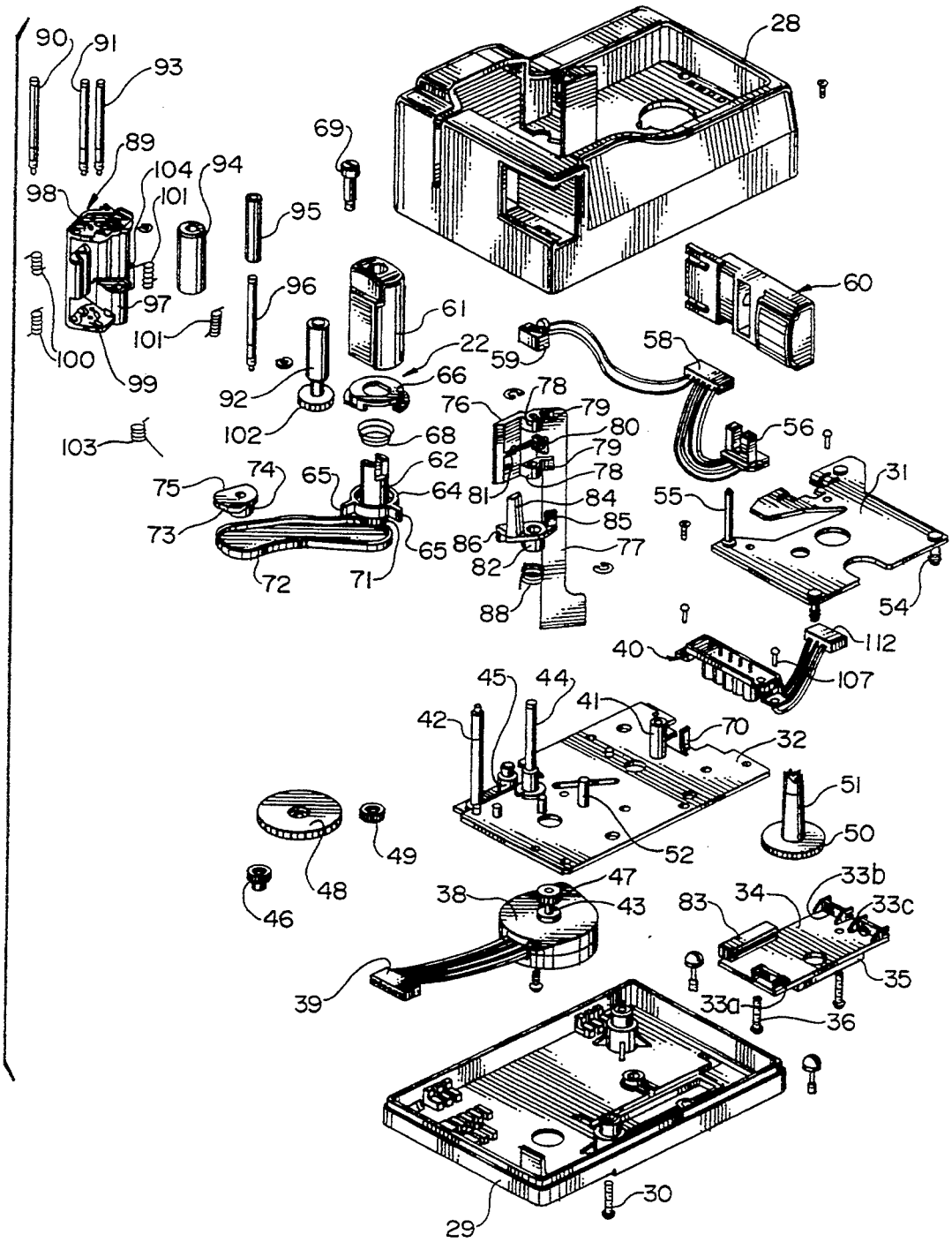
FIG. 2 is an exploded view of the print module.
Figure 3:
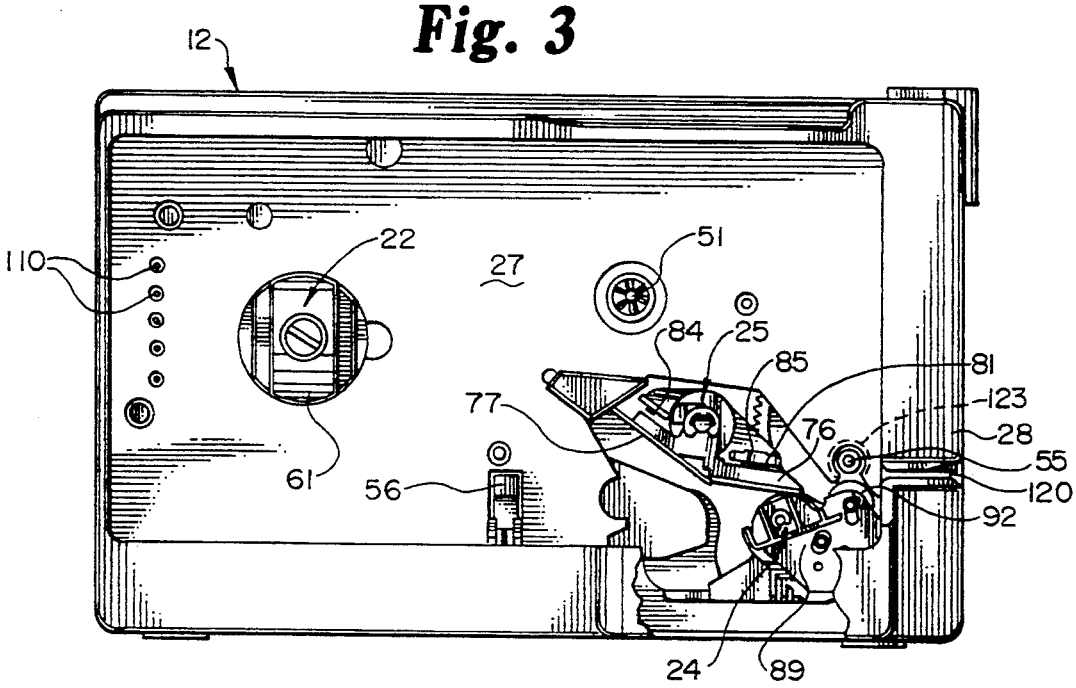
FIG. 3 is a front elevational view of the print module, with portions cut away, showing the platen roller and the print head assemblies in a print position.
Figure 4:
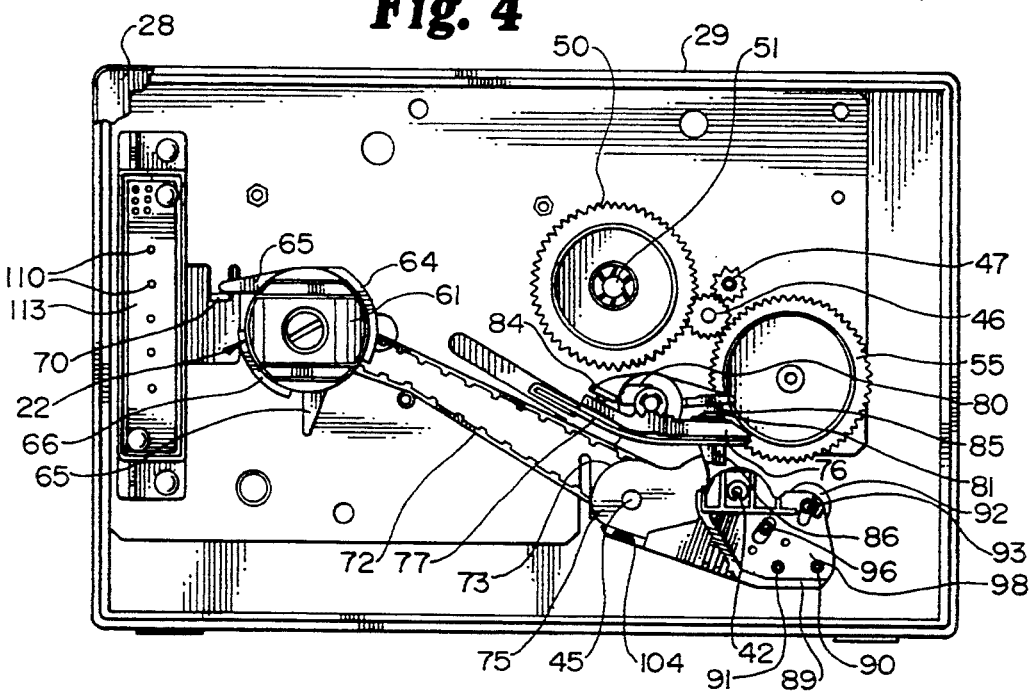
FIG. 4 is a partial cutaway view similar to FIG. 3 with the bottom surface of the cartridge receiving cavity and portions of the top gear plate removed and with the platen roller and the print head in a non-print position.

General reference is next made to FIGS. 3 and 4, with more specific reference to FIG. 2. FIGS. 3 and 4 are front or top views of the print module in its assembled form while FIG. 2 shows the individual elements of the print module in an exploded form. The print module housing 21 includes a front or top housing portion 28 and a rear or bottom housing portion 29 with connection means in the form of a plurality of screws 30 for securing the same together. Mounted within the housing between the upper 28 and lower 29 portions are top and bottom gear plates 31 and 32, respectively, for supporting the various functional components of the print module. Connected to the bottom surface of the bottom gear plate 32 is a printed circuit connection board 34 which embodies the main contact interface 35 of the print module as well as other electrical connectors associated with various functional components of the printer. Specifically, the board 34 also includes the connector 83 for the printhead and connector mounts **33*a*, 33*b* and 33*c* for connectors relating to the stepper motor, tape cutoff and tape sensing means, respectively. The interface 35 is designed for electrical connection with the keyboard module interface 19 (FIG. 1 ). The connection board 34 is connected to the plate 32 by a pair of screws 36. Also connected to the lower surface of the bottom gear plate 32 is a stepper motor 38 having an electrical connector 39 for interface with a mating connector mount 33*a* on the connection board 34**.

The top surface of the bottom gear plate 32 is provided with the cartridge sensing assembly 40, a support post 41 for supporting the locking assembly 22 (FIG. 1), a platen roller support post 42, a print head support post 44 and a cam support post 45. A gear train comprising a plurality of gears 46, 48, 49 and 50 is also supported by the plate 32. The gear 50 is integrally formed with the ribbon rewind shaft 51 which is mounted for rotation on the ribbon rewind support post 52. The remaining gears 46, 48 and 49 are mounted relative to the plate 32 on appropriate support shafts and function to drive the ribbon rewind and shift clutch shaft 51 and the tape advancement mechanism as described below.

The top gear plate 31 is spaced from and connected to the bottom gear plate 32 by a plurality of pins 54. Connected with the top surface of the plate 31 are a cartridge roller support post 55 and an optical tape sensor element 56. The element 56 includes optical means for sensing the existence of tape and, when die cut tape is used, means for setting the position of the label. The sensing mechanism 56 is electrically connected to a connector 58 which turn is mounted to the connector board 34 at the connector mount 33*b*. Also electrically connected to the member 58 is a microswitch 59 positioned within the top housing portion 28 for sensing actuation of the tape cutoff mechanism 60.

With continuing reference to FIGS. 2, 3 and 4, the locking knob assembly 22 includes a manually rotatable knob 61 mounted to and rotatable with a knob support sleeve 62. A rotation limit member 64 having a pair of limit wings 65, 65 is integrally formed with the support sleeve 62 and is thus also rotatable with the knob 61. The knob 61, sleeve 62 and member 64 are rotatably mounted to the locking knob support post 41 and are retained in that position by a threaded screw 69 extending through the knob 61 and sleeve 62 and into the top end of the post 41. In this position, the wings 65, 65 limit movement of the knob to a 90 degree range as a result of engagement between the wings 65, 65 and a stop member or tab 70 integrally formed with the plate 32. This limited movement defines movement of the knob 61 between an operative or print position and a non-operative or non-print position. Disposed between the knob 61 and the sleeve 62 is a pressure cap 66 which is biased upwardly by a coil spring 68 against a portion of the bottom of the inserted cartridge. The bottom surface of the knob 61 includes a beveled surface for engagement with mating portions of the cartridge bottom wall and opposite sides of the cylindrical knob 61 include flat surfaces to facilitate insertion of the cartridge over the knob 61.

A toothed pulley 71 is integrally formed with the lower end of the sleeve 62 and is adapted for engagement with a toothed belt 72. The belt 72 extends from the pulley 71 to a corresponding toothed pulley 74 integrally formed with a combination printhead/platen cam 75. The cam 75 is rotatably supported on the cam support post 45 and includes a cam surface 73. With the above structure, rotation of the knob 61 results in corresponding rotation of the cam 75 about the post 45.

Figure 5:
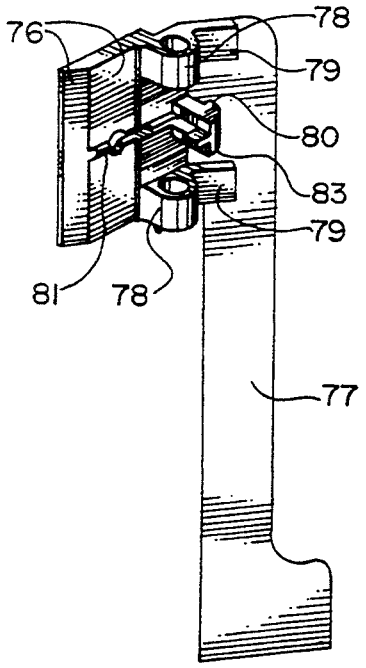
FIG. 5 is a perspective view of the print head of the present invention.

As shown best in FIGS. 2 and 5, the printhead assembly includes a printhead 76 which is rotatably mounted relative to the fixed printhead mounting post 44 via a pair of integrally formed bearing members 78, 78. The bearing members 78, 78 are positioned at the ends of the printhead 76 and each includes an opening for receiving the post 44. The openings in the bearing members 78, 78 are slightly elongated and are larger than the diameter of the post 44, thereby permitting limited floating movement of the printhead 76 relative to the post 44. Means in the form of a center support 80 and a center force transfer rib 81 are provided to ensure substantially uniform application of pressure over the front face of the printhead 76. The support 80 includes a tab member 83 for engagement with a surface of the post 44 as shown in FIGS. 2–4. A pair of disengagement tabs 79 extend from the members 78 on the side of the post 44 opposite the printhead 76.

Associated with the printhead 76 is a force or moment transfer member 82 which is also rotatably supported on the printhead support post 44. The member 82 includes an upstanding print force or moment transfer arm 84 and oppositely disposed an upstanding disengagement arm 85. A torsion spring 88 surrounds the lower end of the member 82 and functions to bias the member 82 in a rotational direction urging the arm 84 into engagement with the force transfer rib 81. When in print position, the force transfer arm 84 engages the rib 81 to transfer printing force from the spring 88 to the printhead 76. The disengagement arm 85 is adapted for engagement with one of the disengagement tabs 79 to rotate the printhead 76 to a non-print position against the force of the spring 88. The member 82 also includes a cam receiving surface 86 for engagement with a surface of the combination cam 75. Rotation of the cam 75 in a counter-clockwise direction causes engagement between a portion of the cam 75 and the surface 86 to rotate the member 82, and thus the printhead 76, to its non-print position shown in FIG. 4.

Also associated with the printhead 76 is a flexible connector cable 77 for electrically activating the print strip on the front face of the printhead in a manner conventional in the art. One end of the cable is connected to the printhead 76 to define a printline and the other end is electrically connected with the connector 83 on the connection board 34.

The platen roller and tape advancement assembly is illustrated in FIG. 1 by the general reference character 24. As shown in FIGS. 2, 3, 4 and 6, such assembly includes a support yoke 89 or arm, a pair of torsion spring support posts 90, 91, a tape advancement or nip roller 92 and support post 93, and an idler roller 95 and support post 96. Each of the above elements is supported between upper and lower yoke end portions 98, 99 of the yoke or arm 89. Both the tape advancement roller support post 93 and the idler roller support post 96 are journaled in generally enlarged and elongated openings within the upper and lower yoke portions 98, 99, thereby providing such members with a floating support. The entire yoke 89 and the supported tape advancement roller 92 together with the platen roller 94 are rotatably mounted on the platen roller support post 42. The post 42 in turn is fixed to the plate 32. Thus, the platen roller 94 is rotatably mounted relative to the support post 42 which in turn is fixed relating to the printer housing. A torsion spring is supported on the post 42 and housed in the sleeve 97 of the engagement arm 89 to allow disengagement of the arm 89 at a no-print position. As shown best in FIG. 6, spring support post 90 carries a pair of torsion springs 100 which act against the support post of 93 of the roller 92 to bias the roller 92 toward a corresponding tape advancement or nip roller 123 (FIG. 8) in the cartridge. The post 91 carries a pair of similar torsion springs 101 for biasing the post 96 of the idler roller 95 toward the nip and platen rollers 92 and 94. The idler roller 95 engages both the nip roller 92 and the platen roller 94 throughout their entire lengths and thereby transfers rotational movement of the nip roller 92 to the platen roller 94. The lower end of the nip roller 92 includes an integral gear member 102 for engagement with a portion of the gear train, and in particular the gear 49.

As illustrated best in FIGS. 3 and 4, the yoke or arm 89 includes a cam receiving surface 104 extending outwardly from one side for engagement by the cam surface 73 of the combination cam 75. As a result of engagement between the cam 75 and the surface 104, rotation of the cam 75 by virtue of rotation of the locking knob 61 causes movement of the yoke 89 and thus its supported nip roller 92 and other components between an operative or print position as illustrated in FIG. 3 and a non-print position as illustrated in FIG. 4.

The print mechanism, and in particular the gear train which drives the tape advancement rollers and the ribbon rewind, is driven by a stepper motor 38. The motor 38 is electrically connected to the connector 39 which is mounted to the connector mount 33*a* in the connector board 34. The motor 38 includes a drive shaft 43 connected with a drive gear 47 for connection with the gear member 46. The gear 46 in turn drives the gear 48 and the ribbon rewind gear 50. The bottom surface of the gear 48 includes a smaller, integral gear (not shown) for engagement with the gear 49. The gear 49 in turn meshes with and drives the gear 102 of the nip roller 92 when the roller is in a print position.

Figure 11:
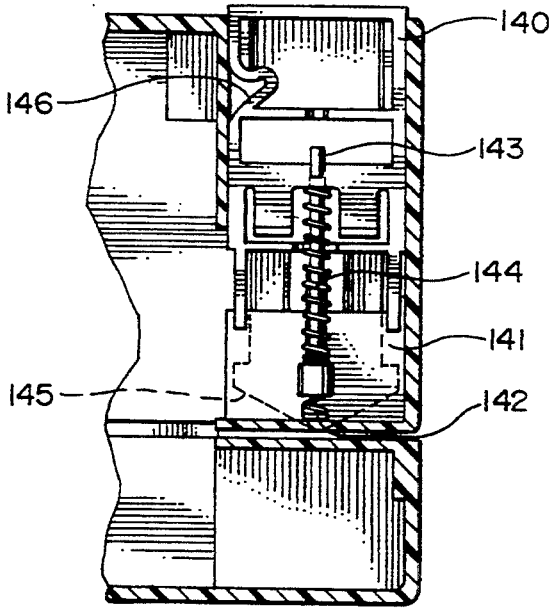
FIG. 11 is an elevational back view of the tape cut-off mechanism.

As shown in FIG. 2, a tape cutoff mechanism 60 is supported in one end of the upper housing portion 28. The details of the mechanism 60 are illustrated in the elevational view of FIG. 11. As shown, the tape cutoff mechanism includes a manually depressible member 140, a blade guide and tape holddown member 141, a tape guide spring support post 143, a cutoff blade 145 and a pair of compression springs 142 and 144. During depression of the member 140, initial movement will result in movement of the guide 141 against the spring 142 until the guide 141 contacts the top surface of the tape. Thereafter, relative movement between the guide 141 and the member 140 will occur against the force of the spring 144, thus causing the blade 145 to extend from the guide 141 to cut the tape. The member 140 includes a recess 146 to receive the microswitch 59. The mounting of the microswitch 59 within the recess 146 is such that when the member 140 is moved, the microswitch disconnects the tape feed to prevent jamming of tape against the cutoff blade. The microswitch 59 is electrically connected with the connector member 58.

Figure 7:
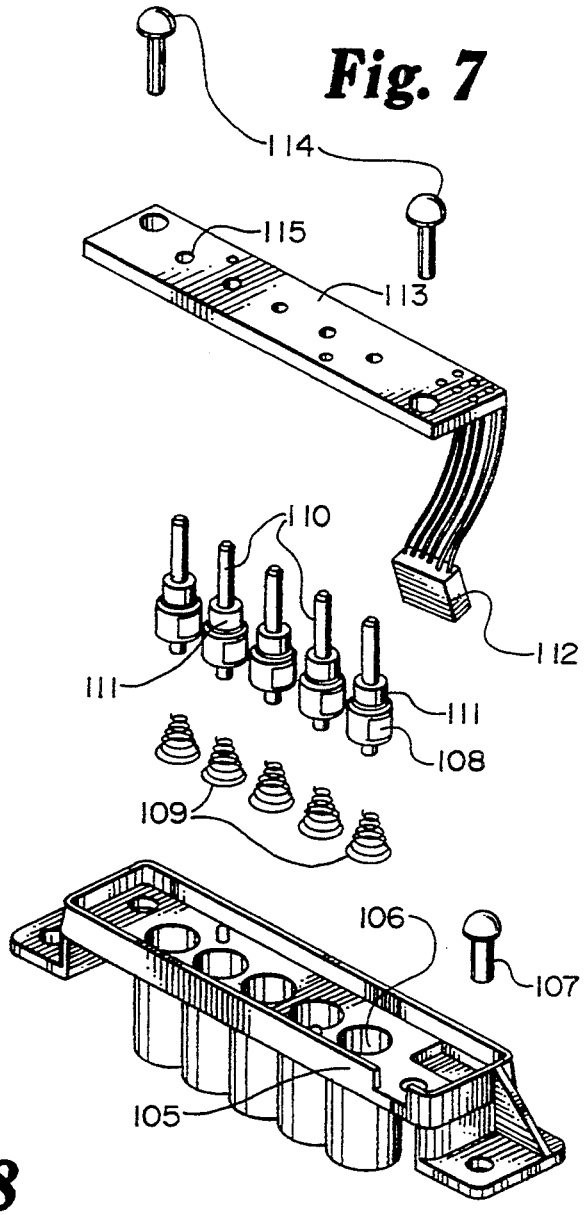
FIG. 7 is an exploded view of the tape supply sensing and switch mechanism.

Reference is again made generally to FIG. 2, with more specific reference to FIG. 7, showing the switch mechanism for sensing information regarding the size and type of tape within a particular cartridge and facilitating automatic print parameter adjustment. Such mechanism includes a main housing 105 connected with the top surface of the bottom gear plate 32 by a pair of rivets 107. The housing 105 is provided with a plurality of switch cavities 106 to receive an equal number of plunger assemblies 108 which, together with the printed circuit board (PCB) 113 and its components, from a plurality of switch assemblies. Each of the plunger assemblies 108 includes an elongated, upwardly extending pin 110 and a conductive elastomer collar portion 111. The plunger assemblies are mounted within the cavities 106 and are biased upwardly away from the cavities by the compression springs 109. The assemblies 108 and springs 109 are captured within the cavities by the top PCB 113 which is connected with the housing 105 by a pair of rivets 114. Contacts from the PCB 113 are electrically connected by the connector 112 to the connector mount **33*c* on the connection board 34 (FIG. 2). The PCB 113 includes a plurality of holes 115 to accommodate and receive the pins 110 of the plunger assemblies 108. Thus, when the PCB 113 is secured to the housing 105, the pins 110 extend upwardly through the holes 115 as shown in FIG. 2**.

Figure 12:
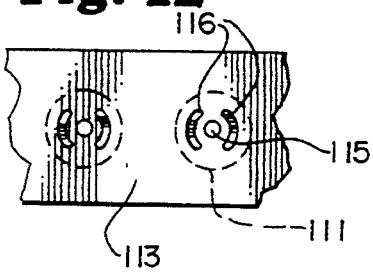
FIG. 12 is an elevational view of the bottom side of the printed circuit board associated with the plunger switches.
Figure 13:
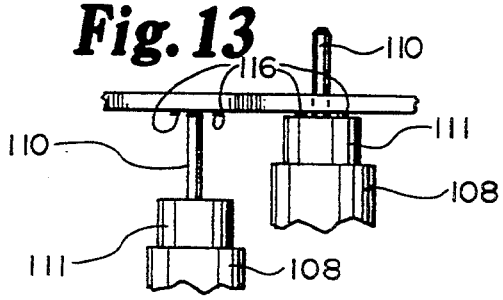
FIG. 13 is a view, partially in section, of a pair of plunger switches, one in a closed position and the other in an open position.

As shown in FIGS. 12 and 13, the underside of the PCB 113 is provided with a pair of contacts 116, 116, which, unless bridged by external means, are electrically disconnected from one another. If the plunger 108 is depressed, the elastomer does not engage the contacts 116. Thus the contacts 116, 116 remain disconnected. Such a situation is illustrated on the left hand side of FIG. 13. If, on the other hand, the plunger 108 is extended, the conductive elastomer 111 bridges the contacts 116, 116 thereby completing the circuit and closing the switch. Thus, the plurality of plunger assemblies 108 in combination with the particular configuration of the PCB 113 and the plurality of contact pairs 116 on its bottom side form a plurality of switches which are adapted to interface with the tape supply cartridge as described below.

Figure 8:
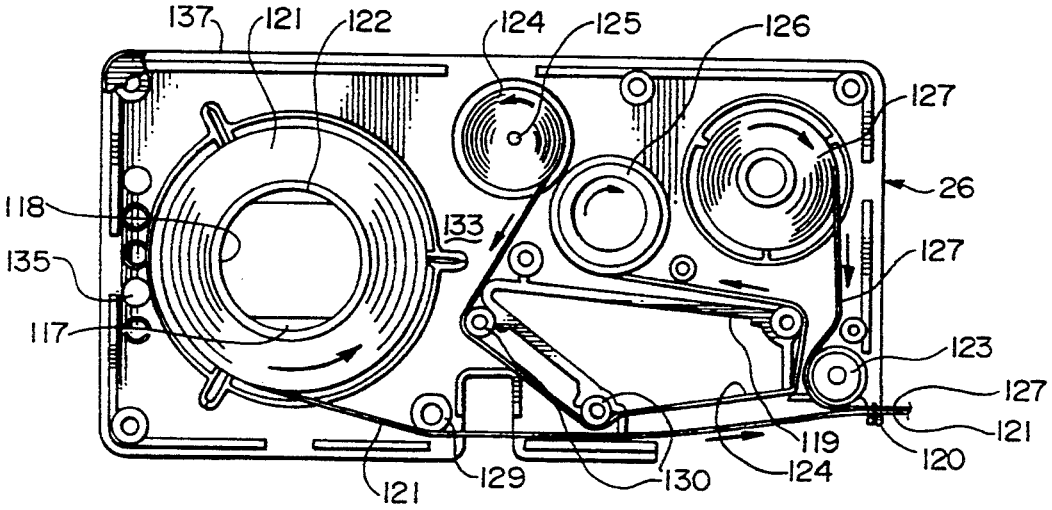
FIG. 8 is a cut away view of the inside of the tape supply cartridge with the top cover removed.
Figure 9:
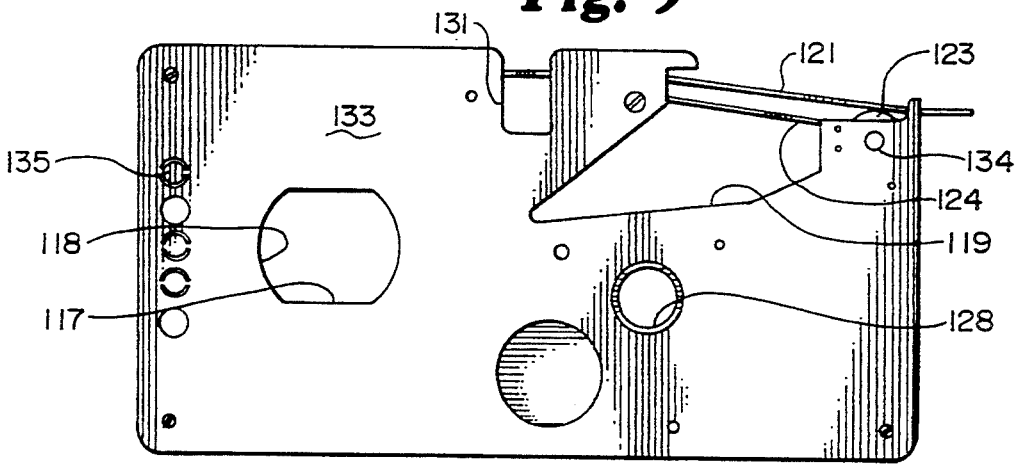
FIG. 9 is an elevational bottom view of the tape supply cartridge of the present invention.

The tape supply cartridge 26 is illustrated generally in FIG. 1 and more specifically in FIGS. 8 and 9. As shown, the cartridge 26 includes top 127 and bottom 133 walls and an edge wall 137 joining the top and bottom walls. The cartridge is adapted to be received within the cartridge cavity 27 (FIG. 1) and includes a generally cylindrically opening 118 with side locking tabs 117 on the bottom wall to receive the lock knob 61 upon insertion of the cartridge 26 into cavity 27. The cartridge also includes a printhead opening 119 for receiving the printhead assembly and a tape opening 120 for exit of the tape from the cartridge 26. As illustrated best in FIG. 8 in which the cover of the cartridge has been removed, the cartridge includes a tape supply 121 mounted on a tape supply spool 122, a ribbon supply 124 mounted on a ribbon supply spool 125 and a ribbon takeup spool 126 for mounting onto the ribbon takeup post 51 (FIG. 2). A nip roller 123 is rotatably supported between the top and bottom cartridge walls and is adapted to slip over and be rotatably supported by the roller support post 55 when the cartridge is inserted into the cavity 27. The post 55 is fixed to the plate 31 and thus rotatably supports the roller 123 during a print cycle. If desired, a scratch resistant laminating tape supply 127 mounted on a laminating spool can also be supplied. When present, the laminating tape is guided around the nip roller 123 and laminated onto the printed surface of the tape 121. Also provided are a plurality of tape and ribbon guide posts and rollers 129, 130.

Figure 10:
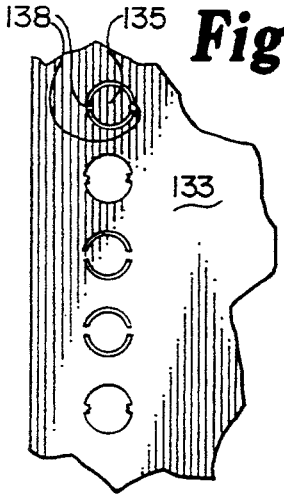
FIG. 10 is an enlarged view of a plurality of the plunger switch stop or mating members associated with the tape supply cartridge.

The bottom surface of the bottom wall 133 of the supply cartridge 126 is illustrated in FIG. 9. Such bottom surface includes an opening 128 for receiving the ribbon takeup post, an opening 131 to receive the tape sensing member 56 (FIG. 2) an opening 134 to receive the cartridge tape advancement roller 123 and a plurality of selectively removable stops or punch-out tabs 135 positioned and adapted for mating operation with the pins 110 of the plunger assemblies 108 (FIG. 7). As illustrated best in FIG. 10, each of the punch-out tabs 135 includes a pair of connection tabs 138, 138, connecting the punch-out tabs 135 to the main cartridge body. The connection tab 138, 138 are narrow enough to facilitate easy selective removal of the punch-out tabs 135 when desired. A punch-out tab 135 is associated with each of the pins 110 of the plunger assemblies 108. In the preferred embodiment, five such assemblies exist. By selectively punching out one or more of the tabs 135 to identify the size and type of tape, etc. in the cartridge, a corresponding one or more of the pins 110 is allowed to extend through the opening created by the punched out tab, thereby activating those particular plunger switches. With this mechanism, information regarding the tape in the particular cartridge such as the size of tape, whether it is laminated or not, whether it is die-cut or not, whether it is a shrink tube, etc. can be communicated to the processing unit upon insertion of the cartridge. With the five binary switches of the preferred embodiment, up to 32 different variables can be provided. Accordingly, depending upon the binary coded switch combinations that are present upon insertion of the cartridge, the print parameters of the printer will be automatically adjusted to best print the particular supply within the cartridge. Examples of print parameters which can be automatically adjusted include amount of heat to the printhead, preheat pulses, strobe times, motor speed, character height default, etc.

Having described the structure of the present invention in detail, its operation can be understood best as follows. First, a tape supply cartridge 26 is inserted into the cavity 27 so that the locking knob 61 extends through the opening 118, the printhead 76 extends through the opening 119 and the ribbon rewind and slip clutch post 51 and tape advancement roller post 55 extend into the openings 128 and 134 (FIG. 9), respectively. Prior to such insertion, a plurality of pins 110 from the plunger assemblies extends above the bottom floor of the cavity 27. The cartridge also includes a corresponding number of openings or punch-out tabs 135 aligned with the pins to provide information to the processing unit regarding tape size, etc. A preselected number and sequence of holes are provided, or a preselected number and sequence of tabs 135 are punched out to automatically convey the correct information regarding tape size, etc. During insertion of the cartridge, the locking knob 61 is in the non-print position illustrated in FIG. 4.

After the cartridge has been inserted, the locking knob 61 is rotated 90 degrees to the print position illustrated in FIG. 3. When this is done, the lower cam surface of the locking knob 61 engages the lockdown tabs 117 on either side of the opening 118. This locks the cartridge against the bottom of the cartridge cavity 27 to ensure proper mating engagement between the tabs 35 which are not punched out and the pins 110. Rotational movement of the locking knob 61 also results in rotation of the combination cam 75 via the belt 72. This results in corresponding pivotal movement of the yoke 89 and thus the tape advancement roller 92 toward a print position. Specifically, the yoke 89 and roller 92 pivot relative to the fixed platen roller post 42. Rotation of the knob 61 and cam 75 also results in the disengagement arm 85 being released from the disengagement tab 79 of the printhead, thereby allowing the force generated via the spring 88 through the force transfer arm 84 to rotate the printhead 76 into engagement with the platen roller 94. Such movement sandwiches the tape 121 and ribbon 124 between the platen roller 94 and printhead 76 so that printing can occur.

By depressing selected keys on the keyboard, print signals can be communicated to the printhead to cause the printing of selected characters on the image receiving tape 121. When printing is completed, the tape is cutoff by manually depressing the tape cutoff button 140. Another print cycle can then be performed. To remove the cartridge, the locking knob 61 is rotated 90 degrees to the position illustrated in FIG. 4. This results in a pivoting of the yoke 89 and tape advancement roller 92 toward a non-print position and a rotation of the printhead away from the platen roller 94.

Although the description of preferred embodiment has been quite specific, it is contemplated that various modifications could be made without deviations from the spirit of the present invention. Accordingly, it is intended that the scope of the present invention be dictated by the appended claims rather than by the description of the preferred embodiment.

We claim:

1. A thermal printing device comprising:

a device housing;

a cartridge receiving cavity for receiving a tape supply cartridge;

a platen roller support post fixed relative to said device housing;

a platen roller assembly including a platen roller disposed outside of said tape supply cartridge and rotatably mounted on said platen roller support post; and a print head movable toward and away from said platen roller between a print position and a non-print position, respectively.

2. The thermal printing device of claim 1 wherein said platen roller assembly includes a first tape advancement roller rotatably mounted on a first tape advancement roller axis parallel to said platen roller support post.

3. The thermal printing device of claim 2 wherein said platen roller assembly includes yoke means rotatably mounted on said platen roller support post for supporting said first tape advancement roller axis.

4. The thermal printing device of claim 3 including a second tape advancement roller axis fixed relative to said device housing for rotatably supporting a second tape advancement roller disposed within said tape supply cartridge.

5. The thermal printing device of claim 3 wherein said platen roller assembly is rotatably movable relative to said platen roller support post between a print position and a non-print position.

6. The thermal printing device of claim 5 including bias means for biasing said platen roller assembly toward its print position.

7. The thermal printing device of claim 1 including a print head support post and wherein said print head is rotatably mounted on said print head support post, is rotatably movable between said print position and said non-print position and is allowed to pivot about the center line of the print column.

8. The thermal printing device of claim 1 including cartridge lock means for locking said tape supply cartridge into a print position relative to said cartridge cavity and positioning means connected with said lock means for moving said print head between said print and non-print positions.

9. A thermal printing device comprising:

a device housing;

a cartridge receiving cavity for receiving a tape supply cartridge;

a platen roller;

a print head support post fixed relative to said device housing;

a print head assembly including a print head rotatably mounted on said print head support post and rotatably movable between a print position and a non-print position; and a force transfer member rotatably mounted relative to said print head support post and having a first force transfer arm for rotating said print head toward said print position and a second force transfer arm for rotating said print head toward said non-print position.

10. The thermal printing device of claim 9 wherein said print head includes at least one mounting hole for rotatably receiving said print head support post wherein said mounting hole is greater in diametrical dimension than the diametrical dimension of said print head support post.

11. The thermal printing device of claims 10 wherein said at least one mounting hole is elongated in cross-section configuration.

12. The thermal printing device of claim 9 wherein said print head includes a front print face for operative cooperation with said platen roller and a rear surface opposite said front print face and wherein said rear surface includes a force transfer rib for engagement by said first force transfer arm.

13. The thermal printing device of claim 12 wherein said rear surface includes a length dimension measured in a direction parallel to said print head support post and wherein said force transfer rib is position at the approximate center of said length dimension.

14. The thermal printing device of claim 10 wherein said print head includes a centering tab for engagement with said print head support post.

* * * * *